US011753892B2

(12) United States Patent
Nguyen

(10) Patent No.: US 11,753,892 B2
(45) Date of Patent: Sep. 12, 2023

(54) ELECTRICALLY ACTIVATED DOWNHOLE ANCHOR SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/508,245

(22) Filed: Oct. 22, 2021

(65) Prior Publication Data

US 2023/0129281 A1 Apr. 27, 2023

(51) Int. Cl.
*E21B 29/06* (2006.01)
*E21B 23/01* (2006.01)

(52) U.S. Cl.
CPC ..... *E21B 29/06* (2013.01); *E21B 23/01* (2013.01)

(58) Field of Classification Search
CPC ..... E21B 23/01; E21B 29/06
See application file for complete search history.

(56) References Cited

U.S. PATENT DOCUMENTS 2,207,920 A * 7/1940 Hughes ..... E21B 7/061 175/81
5,109,924 A * 5/1992 Jurgens ..... E21B 7/061 175/391
5,893,413 A 4/1999 Lembcke et al.
6,318,466 B1 11/2001 Ohmer et al.
7,357,182 B2 4/2008 Hunt et al.
11,421,496 B1 8/2022 Nguyen et al.
2003/0183388 A1* 10/2003 Toulouse ..... E21B 7/061 166/117.6
2003/0205374 A1 11/2003 Toulouse et al.
2011/0203063 A1 8/2011 Atkins et al.
2015/0021029 A1 1/2015 Abrant et al.
2015/0090459 A1 4/2015 Cain et al.
2016/0145973 A1 5/2016 Lykkebo
(Continued)

FOREIGN PATENT DOCUMENTS

CN 107237612 A 10/2017
EP 1592865 B1 8/2007
(Continued)

OTHER PUBLICATIONS

International Search Report and Written Opinion dated Feb. 14, 2023 in PCT/US20221046869; 11 pages.
(Continued)

*Primary Examiner* — D. Andrews
*Assistant Examiner* — Ronald R Runyan
(74) *Attorney, Agent, or Firm* — CANTOR COLBURN LLP

(57) ABSTRACT

A system for a downhole tubular includes a tubular having an outer surface and an inner surface. An anchor setting system is disposed in the tubular. The anchor setting system includes a motor system. An anchor assembly is disposed on the tubular. The anchor assembly includes slip and a setting system having a piston assembly. A window cutting system is arranged along the tubular. An actuator extends from the motor system, through the window cutting system, to the piston assembly. The motor system is selectively activated through a signal to deploy the slip.

20 Claims, 8 Drawing Sheets

(56) References Cited

U.S. PATENT DOCUMENTS

| | | | | |
|---|---|---|---|---|
| 2016/0230508 | A1 | 8/2016 | Jensen | |
| 2016/0305232 | A1 | 10/2016 | Bird et al. | |
| 2017/0067318 | A1 | 3/2017 | Haugland et al. | |
| 2017/0350203 | A1* | 12/2017 | Rud | H01F 7/06 |
| 2018/0135372 | A1 | 5/2018 | Degeare et al. | |
| 2019/0003264 | A1 | 1/2019 | Swadi et al. | |
| 2019/0106940 | A1 | 4/2019 | Korf et al. | |
| 2019/0162046 | A1 | 5/2019 | Engevik et al. | |
| 2020/0190908 | A1 | 6/2020 | Pray et al. | |
| 2021/0301615 | A1 | 9/2021 | Harrington et al. | |
| 2021/0372219 | A1 | 12/2021 | Brown-Kerr et al. | |
| 2021/0381339 | A1 | 12/2021 | Taylor et al. | |
| 2022/0162920 | A1 | 5/2022 | Pray et al. | |
| 2022/0268101 | A1 | 8/2022 | Pray | |

FOREIGN PATENT DOCUMENTS

| | | | |
|---|---|---|---|
| EP | 1999338 | B1 | 7/2010 |
| EP | 2366056 | B1 | 6/2014 |
| WO | 2009108068 | A1 | 9/2009 |
| WO | 2013159237 | A1 | 10/2013 |
| WO | 2019083922 | A1 | 5/2019 |

OTHER PUBLICATIONS

International Search Report and Written Opinion dated Feb. 16, 2023 in PCT/US2022/046871; 10 pages.
International Search Report and Written Opinion dated Feb. 17, 2023 in PCT/US2022/046868; 11 pages.

* cited by examiner

ELECTRICALLY ACTIVATED DOWNHOLE ANCHOR SYSTEM

BACKGROUND

In the resource recovery industry various tools are deployed into a tubular string during downhole operations. For example, a work string may be employed into the tubular string to clean internal surfaces prior to setting an anchor. The work string may include scrapers or brushes that are deployed at a specific location. Once deployed the work string may be rotated and moved up and down to clean internal surfaces of the tubular string.

Various technologies may be employed to deploy the anchor after the tubular is prepared. For example, a shifting tool may be deployed to urge a sleeve downward to force the scraper outward. In other cases, pressure may be applied to a piston. The pressure may be applied directly to the piston or by dropping a ball or dart and raising pressure in the work string. In either instance, considerable time is required to deploy the anchor. Running a tool into the work string may take hours or days. Similarly, applying pressure, especially in connection with a ball or dart, can take precious time. Accordingly, operators would welcome a system for more rapidly deploying an anchor in a wellbore.

SUMMARY

Disclosed, in accordance with a non-limiting example, a system for a downhole tubular including a tubular having an outer surface and an inner surface. An anchor setting system is disposed in the tubular. The anchor setting system includes a motor system. An anchor assembly is disposed on the tubular. The anchor assembly includes a setting system having a piston assembly. A window cutting system is arranged along the tubular. An actuator extends from the motor system, through the window cutting system, to the piston assembly. The motor system is selectively activated through a signal to deploy the slip.

Also disclosed, in accordance with a non-limiting example, is a resource exploration and recovery system including a surface system, a subsurface system, and a tubular string extending from the surface system into the subsurface system. The tubular string includes a tubular having an outer surface and an inner surface. An anchor setting system is disposed in the tubular. The anchor setting system includes a motor system, an anchor assembly disposed on the tubular. The anchor assembly includes a setting system having a piston assembly. A window cutting system is arranged along the tubular. An actuator extends from the motor system, through the window cutting system, to the piston assembly. The motor system being selectively activated through a signal to deploy the slip.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
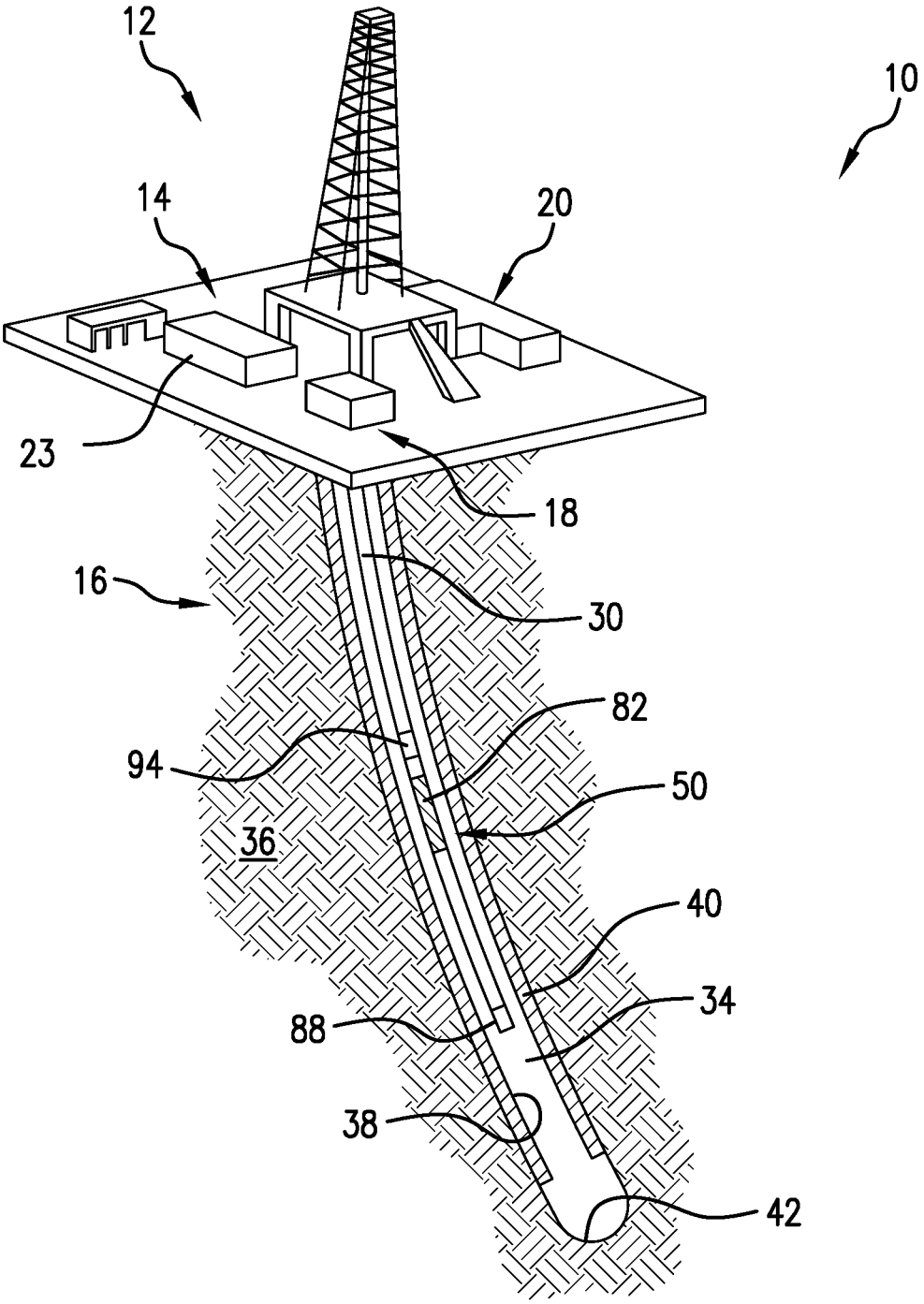
FIG. 1 depicts a resource exploration and recovery system including an electrically activated downhole anchor system, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
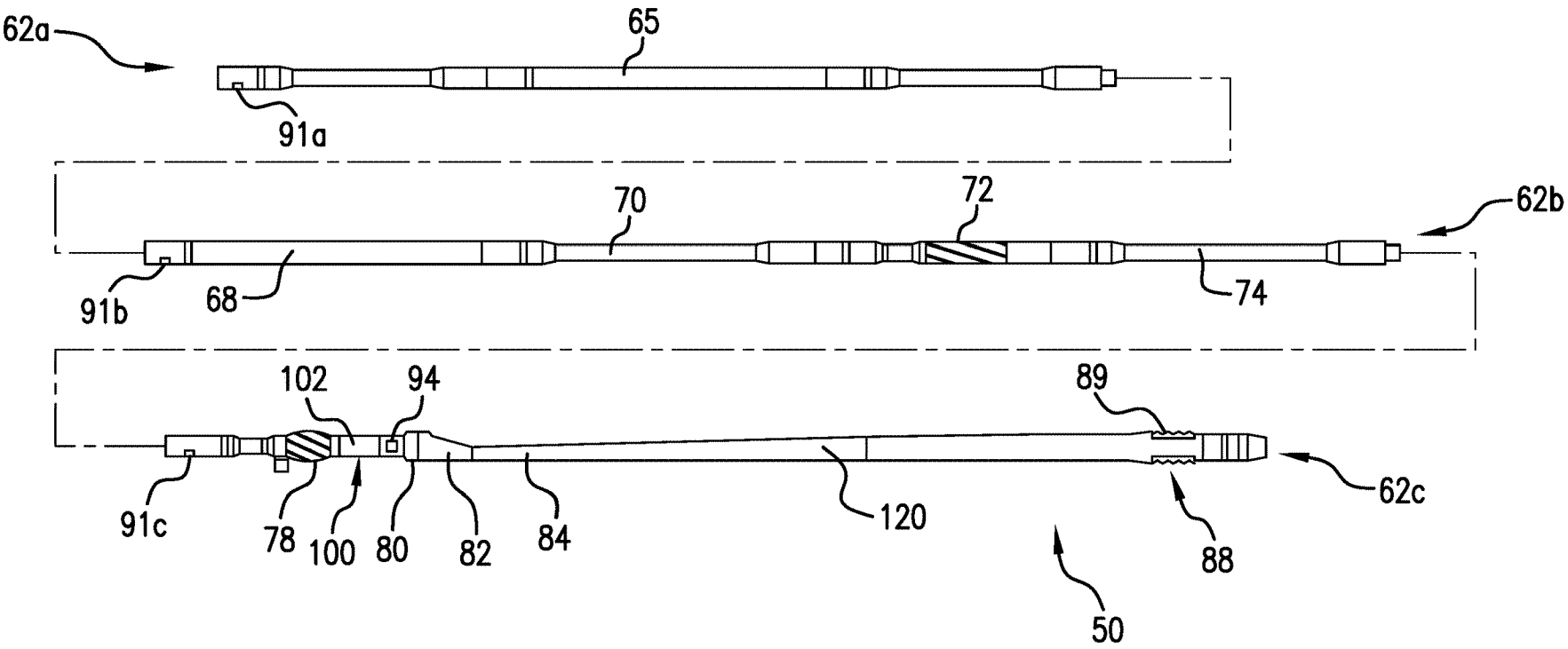
FIG. 2 depicts a work string including the electrically activated downhole anchor system of FIG. 1, in accordance with a non-limiting example.

In accordance with an exemplary aspect, tubular string 30 may support a casing exit or window cutting system 50 as shown in FIG. 2. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34. At this point, it should be understood that while described in connection with a casing exit system, tubular string may support any number of different tools/systems for performing wellbore operations.

In an embodiment, first tubular segment 62*a* may support a measurement while drilling (MWD) system 65 that includes various instrumentation systems which monitor window cutting operations. Second tubular segment 62*b* may include a whipstock valve 68, a first flex joint 70, an upper watermelon mill 72, and a second flex joint 74. Third tubular segment 62*c* may include a lower watermelon mill 78, a window mill 80, a whipstock connector 82, a whipstock 84, and an anchor assembly 88 that may include one or more slips 89. Whipstock connector 82 serves as an interface between window mill 80 and whipstock 84. In a non-limiting example, a plurality of wireless repeaters 91*a*, 91*b*, and 91*c* are arranged on corresponding ones of first, second, and third tubular segments 62*a*, 62*b*, and 62*c*. As will be detailed herein, wireless repeaters 91*a*, 91*b*, and 91*c* are coupled to control system 23 and are operable to promulgate a wireless signal along tubular string 30 to an anchor setting system 94 arranged uphole of window cutting system 50.

Figure 3:
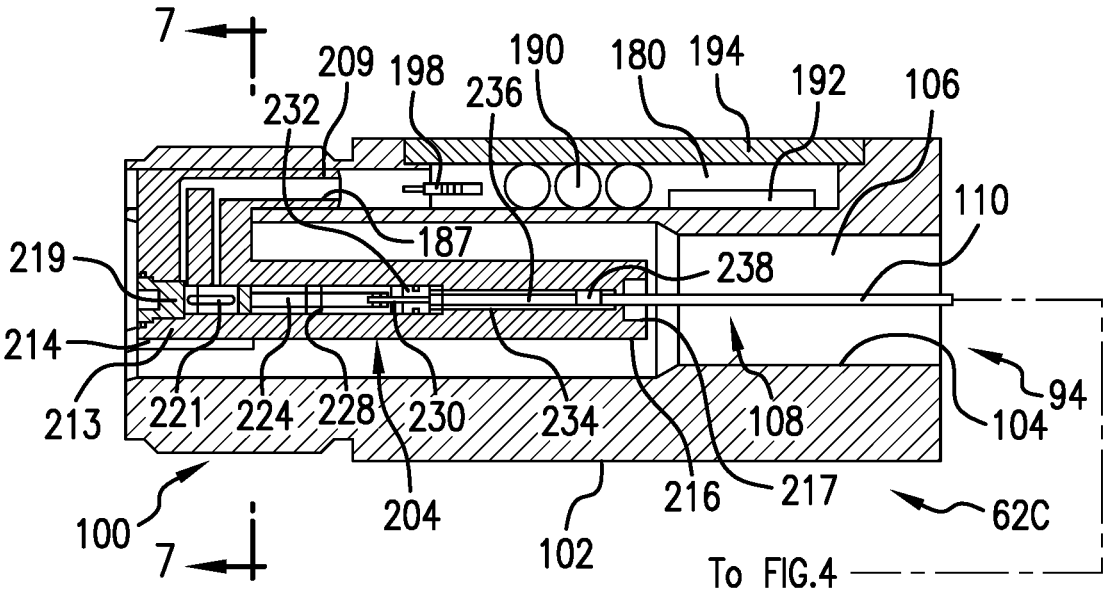
FIG. 3 is a cross-sectional view of a portion of an electrically activated anchor setting system including an actuator, in accordance with a non-limiting example.
Figure 4:
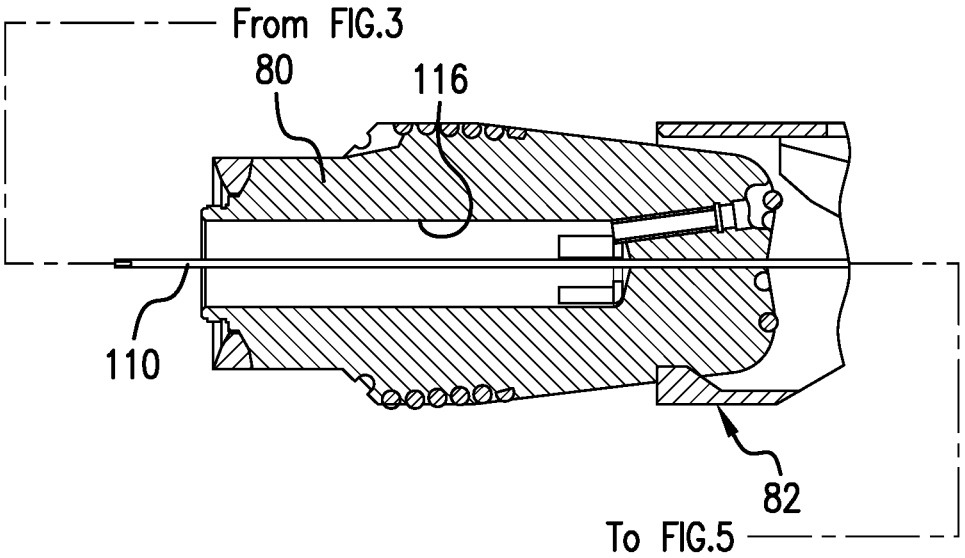
FIG. 4 depicts the actuator of FIG. 3 passing through a window mill and whipstock connector of the work string of FIG. 2, in accordance with a non-limiting example.
Figure 5:
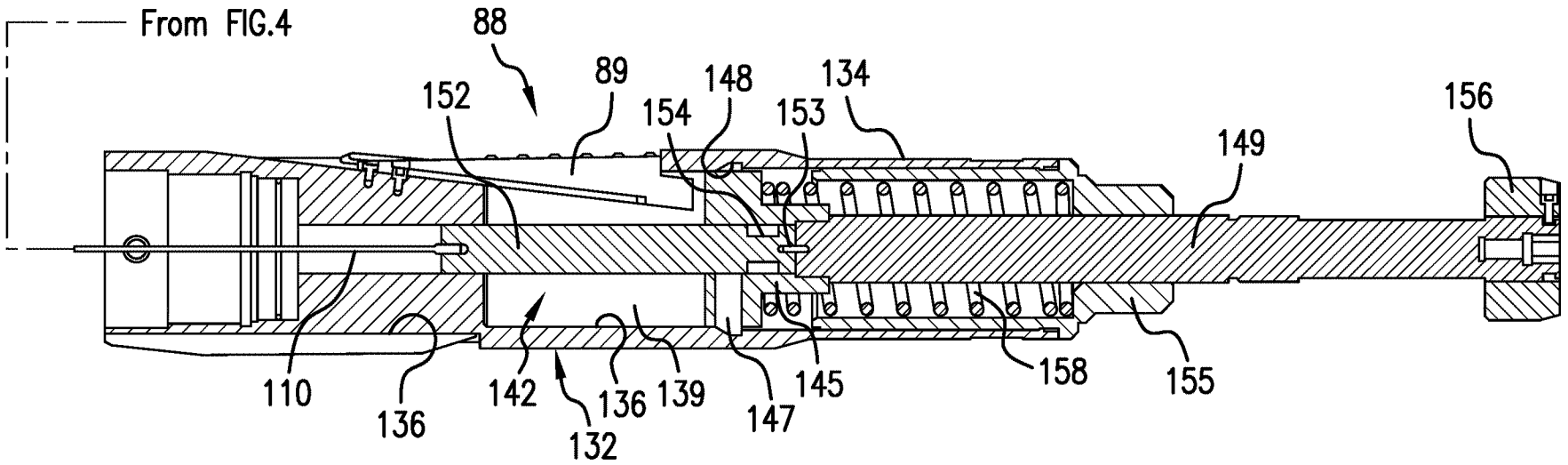
FIG. 5 depicts the actuator of FIG. 3 connecting with an anchor assembly arranged in the work string of FIG. 2.

Referring to FIGS. 3-5 and with continued reference to FIG. 2, in a non-limiting example, third tubular segment 62*c* includes a tubular 100 having an outer surface 102 and an inner surface 104 that defines a pathway 106. An actuator 108, shown in the form of a cable 110 extends along pathway 106 from anchor setting system 94 to anchor assembly 88. In a non-limiting example shown in FIG. 4, window mill 80 includes a passage 116 that facilitates passage of cable 110 to into an additional tubular 120 and on to anchor assembly 88. While shown in the form of a flexible cable 110, actuator 108 may also take the form of a rigid linkage.

In a non-limiting example illustrated in FIG. 5, anchor assembly 88 includes a housing 132 having an outer surface portion 134 and an inner surface portion 136 that defines a compartment 139. A setting system 142 is arranged within compartment 139. Setting system 142 includes a piston assembly 145 slidingly arranged within compartment 139. Piston assembly 145 includes a shear element 147 that selectively engages an annular groove 148 formed on inner surface portion 136. As will be detailed more fully herein, piston assembly 145 is configured to act upon anchor assembly 88 to set slips 89.

In a non-limiting example, a first rod 149 extends from piston assembly 145 in a first, downhole direction, and a second rod 152 extends from piston assembly 145 in a second, or uphole direction. First rod 149 is connected to second rod 152 by a shear member 153. A groove 154 is arranged in second rod 152 adjacent to shear member 153. Groove 154 selectively aligns with shear element 147 to release piston assembly 145 as will be detailed herein. First rod 149 extends through a plug 155 and terminates at a member 156 that may be employed as a contingency to set anchor assembly 88 as will be detailed more fully herein. A power spring 158 extends about first rod 149 and extends between plug 155 and piston assembly 145.

Figure 6:
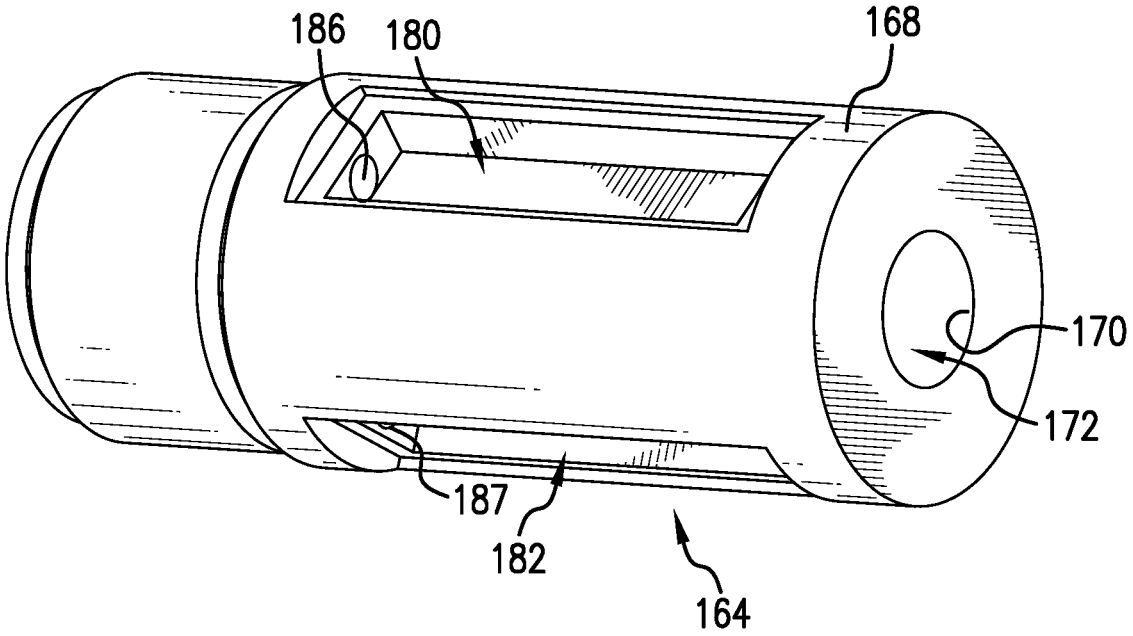
FIG. 6 depicts a perspective view of a motor housing of the anchor setting system of FIG. 3, in accordance with a non-limiting example.
Figure 7:
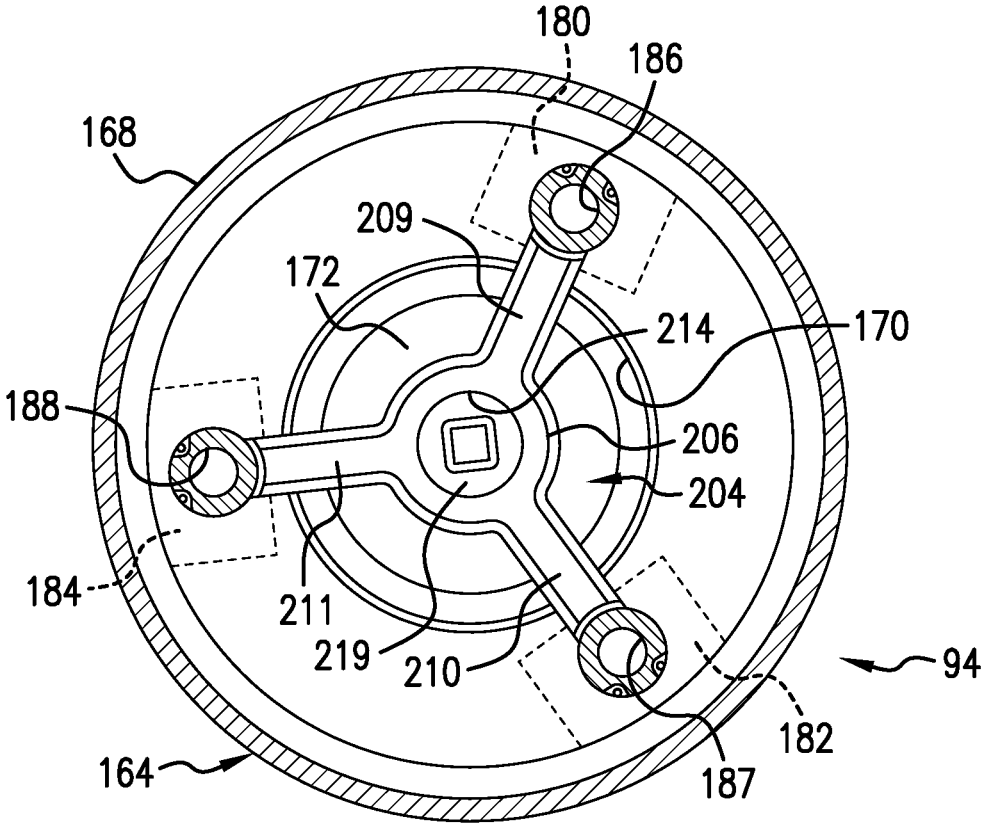
FIG. 7 depicts an axial end view of the anchor setting system of FIG. 3, in accordance with a non-limiting example.
Figure 8:
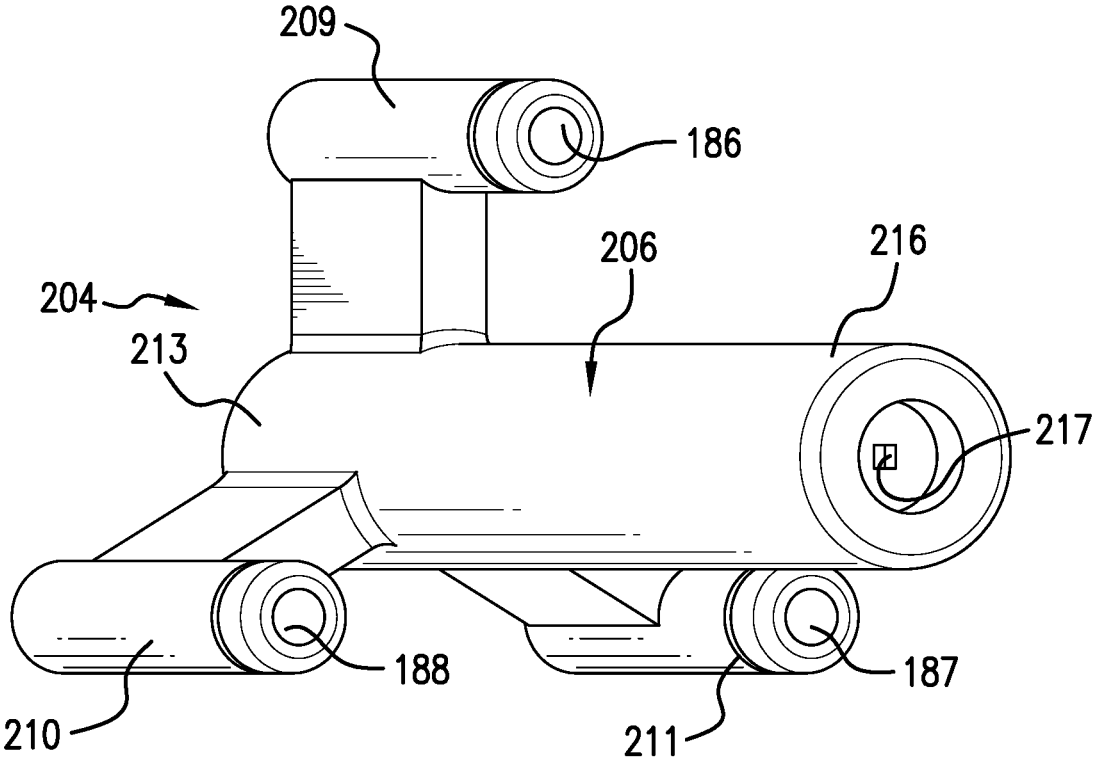
FIG. 8 depicts a perspective view of a motor housing of the electrically activated anchor setting system of FIG. 3, in accordance with a non-limiting example.

Reference will now follow to FIGS. 6-8 with continued reference to FIGS. 2-5 in describing anchor setting system 94 in accordance with a non-limiting example. Anchor setting system 94 includes a motor housing 164 having an outer surface section 168 and an inner surface section 170 that defines a passage 172. In a non-limiting example, motor housing 164 includes a first controls compartment 180, a second controls compartment 182, and a third controls compartment 184. First, second, and third controls compartments 180, 182, and 184 are circumferentially spaced about outer surface section 168. While three controls compartments are shown, the number and orientation of compartments may vary.

In a non-limiting example, first controls compartment 180 includes a first duct 186, second controls compartment 182 includes a second duct 187 and third controls compartment 188 includes a third duct. First duct 186 connects first controls compartment 180 and passage 172, second duct 187 connects second controls compartment 182 and passage 172, and third duct 188 connects third controls compartment 184 and passage 172. In a non-limiting example, each controls compartment 180, 182, and 184 houses a battery 190 and an electronics package 192 and includes a cover 194 as shown in connection with controls compartment 180 in FIG. 3. In a non-limiting example, a connector 198 (FIG. 3) may be positioned in each duct 186, 187, and 188 as also shown in FIG. 3 in connection with controls compartment 180.

In a non-limiting example, motor housing 164 houses a motor support 204 having a support portion 206, a first conduit 209, a second conduit 210, and a third conduit 211. First, second, and third conduits 209, 210, and 211 are arranged radially outwardly of support portion 206. Support portion 206 includes a first end 213 having a first opening 214 and a second end 216 having a second opening 217 that accommodates cable 110. A selectively removeable plug 219 is mounted to first end 213. In a non-limiting example, support portion 206 includes a motor cavity 221 (FIG. 3) disposed between first end 213 and second end 216.

In a non-limiting example, motor cavity 221 supports a motor system 223 that includes a motor 224. In a non-limiting example, motor 224 is a wireless motor that is powered by battery 190 and connects with control system 23 through electronics package 192 and wireless repeaters 191*a*, 191*b*, and 191*c*. It should be understood that the term "wireless motor" describes a motor that receives command and control signals through a wireless interface. Wireless motor 224 may communicate with electronics package 192 through either a wired connection or a wireless connection. However, motor 224 may also be wireline operated in other non-limiting examples. Wireless motor 224 is disposed in a sleeve 228 and includes an output shaft 230 that is supported by a thrust bearing 232. A drive shaft 234 is connected to output shaft 230. Drive shaft 234 includes an internally threaded portion 236 that engages with an externally threaded member 238 of actuator 108.

In a non-limiting example, when anchor assembly 88 is disposed at a selected location in wellbore 34, a signal is passed from control system 23 to each control compartment 180, 182, and 184 in motor housing 164 via wireless repeaters 91*a*, 91*b*, and 91*c*. Powered by batteries 190 in each control compartment 180, 182, and 184, wireless motor 224 rotates output shaft 230. Rotation of output shaft 230 is imparted to drive shaft 234. As drive shaft 234 rotates, externally threaded member 238 translates along internally threaded portion 236 placing actuator 108 in tension.

Continued rotation of drive shaft 234 causes shear member 153 to fracture allowing second rod 152 to translate relative to piston assembly 145. As second rod 152 shifts, shear element 147 moves into groove 154 releasing piston assembly 145 from inner surface 136. At this point, power spring 158 forces piston assembly into slips 89 to set anchor assembly 88. In the event that second rod 152 fails to shift and/or separate, tubular string 30 may transmit a mechanical load to member 156 by tagging a bottom (toe 42) or a false bottom to break shear element 147. The mechanical load will force first rod 149 upward to break shear element 147 to set anchor assembly 88.

Figure 9:
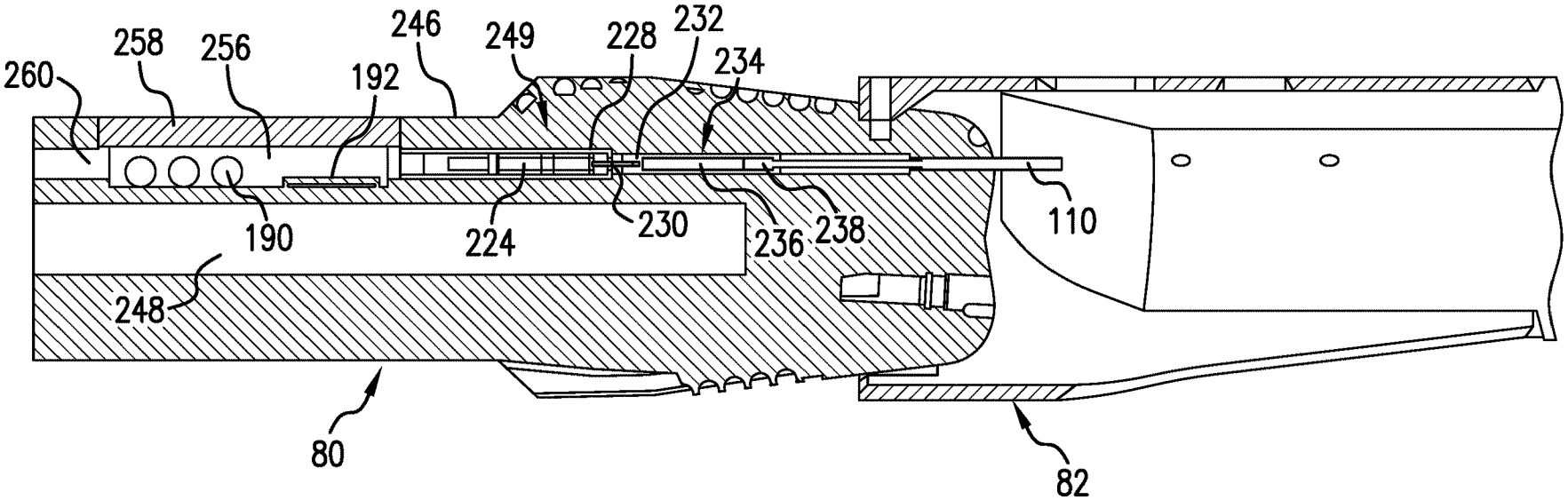
FIG. 9 depicts an electrically activated anchor setting system in accordance with another non-limiting example.

Reference will follow to FIG. 9, wherein like reference numbers represent corresponding parts in the respective views, in describing another non-limiting example. Window mill 80 includes an outer surface section 246 and an inner surface section 247 that defines a central passage 248. A motor housing 249 is defined between central passage 248 and outer surface section 246. A control compartment 256 is formed in outer surface section 246 and is provided with a cover 258. A passage 260 extends through window mill 80 and motor housing 249. Cable 110 passes from window mill 80 from a terminal end (not separately labeled) of passage 260.

In a non-limiting example, motor 224 is arranged in motor housing 249. In a non-limiting example, motor 224 is a wireless motor that is powered by battery 190 and connects with control system 23 through electronics package 192 and wireless repeaters 191*a*, 191*b*, and 191*c*. However, motor 224 may also be wireline operated in other non-limiting examples. Actuator 108 connects with drive shaft 235 through externally threaded member 238. In a manner similar to that discussed herein, motor 224 is activated, drive shaft 234 is rotated, and tension is created in actuator 108. As tension is increased, shear element 147 breaks allowing power spring 158 to urge slip 89 upward and radially outward.

With this arrangement, an anchor assembly may be deployed without the need for wellbore intervention aids such as drop balls, darts, shifting tools, pressure applications and the like. Thus, the anchor assembly may be deployed much more quickly and reliably. Further, once deployed, the tubular string may be disengaged from, for example, the whipstock connector and run out of hole so that the anchor setting system may be removed, serviced, and reused. That is, all electronic components, e.g., the battery, the electronics package, and motor components may be removed with the window mill and not left downhole.

Set forth below are some embodiments of the foregoing disclosure:

Embodiment 1. A system for a downhole tubular comprising: a tubular including an outer surface and an inner surface; an anchor setting system disposed in the tubular, the anchor setting system including a motor system; an anchor assembly disposed on the tubular, the anchor assembly including a slip and a setting system having a piston assembly; a window cutting system arranged along the tubular; and an actuator extending from the motor system, through the window cutting system, to the piston assembly, the motor system being selectively activated through a signal to deploy the slip.

Embodiment 2. The system according to any prior embodiment, wherein the motor system is a wireless motor system.

Embodiment 3. The system according to any prior embodiment, wherein window cutting system includes a window mill and a whipstock, the window mill being selectively connected to the whipstock.

Embodiment 4. The system according to any prior embodiment, wherein the actuator comprises a cable that extends from the wireless motor system through the window mill and the whipstock to the piston assembly.

Embodiment 5. The system according to any prior embodiment, wherein the anchor setting system includes a wireless motor housing having a controls compartment arranged between the outer surface and the inner surface, the controls compartment housing a battery and an electronics package including a wireless receiver, the electronics package providing the signal to the wireless motor system.

Embodiment 6. The system according to any prior embodiment, further comprising a wireless motor support disposed in the wireless motor housing radially inwardly of the outer surface, the wireless motor support including a support portion and a conduit exposed to the controls compartment.

Embodiment 7. The system according to any prior embodiment, wherein the controls compartment includes a first controls compartment, a second controls compartment, and a third controls compartment, the first controls compartment housing a first battery and a first electronics package, the second controls compartment housing a second battery and a second electronics package, and the third controls compartment housing a third battery and a third electronics package.

Embodiment 8. The system according to any prior embodiment, wherein the wireless motor housing includes a first duct extending into the first controls compartment, a second duct extending into the second controls compartment, and a third duct extending into the third controls compartment.

Embodiment 9. The system according to any prior embodiment, wherein the conduit includes a first conduit extending from the support portion into the first duct, a second conduit extending from the support portion into the second duct, and a third conduit extending from the support portion into the third duct.

Embodiment 10. The system according to any prior embodiment, wherein the anchor comprises a slip.

Embodiment 11. A resource exploration and recovery system comprising: a surface system; a subsurface system; and a tubular string extending from the surface system into the subsurface system, the tubular string comprising: an outer surface and an inner surface; an anchor setting system disposed in the tubular, the anchor setting system including a motor system; an anchor assembly disposed on the tubular, the anchor assembly including a slip and a setting system having a piston assembly; a window cutting system arranged along the tubular; and an actuator extending from the motor system, through the window cutting system, to the piston assembly, the motor being selectively activated through a signal to deploy the slip.

Embodiment 12. The resource exploration and recovery system according to any prior embodiment, wherein the motor system comprises a wireless motor system.

Embodiment 13. The resource exploration and recovery system according to any prior embodiment, wherein window cutting system includes a window mill and a whipstock, the window mill being selectively connected to the whipstock.

Embodiment 14. The resource exploration and recovery system according to any prior embodiment, wherein the actuator comprises a cable that extends from the wireless motor system through the window mill and the whipstock to the piston assembly.

Embodiment 15. The resource exploration and recovery system according to any prior embodiment, wherein the anchor setting system includes a wireless motor housing having a controls compartment arranged between the outer surface and the inner surface, the controls compartment housing a battery and an electronics package including a wireless receiver, the electronics package providing the signal to the wireless motor.

Embodiment 16. The resource exploration and recovery system according to any prior embodiment, further comprising a wireless motor support arranged in the wireless motor housing and disposed radially inwardly of the outer surface, the wireless motor support including a support portion and a conduit exposed to the controls compartment.

Embodiment 17. The resource exploration and recovery system according to any prior embodiment, wherein the controls compartment includes a first controls compartment, a second controls compartment, and a third controls compartment, the first controls compartment housing a first battery and a first electronics package, the second controls compartment housing a second battery and a second electronics package, and the third controls compartment housing a third battery and a third electronics package.

Embodiment 18. The resource exploration and recovery system according to any prior embodiment, wherein the wireless motor housing includes a first duct extending into the first controls compartment, a second duct extending into the second controls compartment, and a third duct extending into the third controls compartment.

Embodiment 19. The resource exploration and recovery system according to any prior embodiment, wherein the conduit includes a first conduit extending from the support portion into the first duct, a second conduit extending from the support portion into the second duct, and a third conduit extending from the support portion into the third duct.

Embodiment 20. The resource exploration and recovery system according to any prior embodiment, wherein the anchor comprises a slip.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for a downhole tubular comprising:

a tubular including an outer surface and an inner surface;

an anchor setting system disposed in the tubular, the anchor setting system including a motor system;

an anchor assembly disposed on the tubular, the anchor assembly including a slip and a setting system having a piston assembly;

a window cutting system supported by the tubular; and an actuator extending from the motor system, through the window cutting system, to the piston assembly, the motor system being selectively activated through a signal to deploy the slip.

2. The system according to claim 1, wherein the motor system is a wireless motor system.

3. The system according to claim 2, wherein window cutting system includes a window mill and a whipstock, the window mill being selectively connected to the whipstock.

4. The system according to claim 3, wherein the actuator comprises a cable that extends from the wireless motor system through the window mill and the whipstock to the piston assembly.

5. The system according to claim 2, wherein the anchor setting system includes a wireless motor housing having a controls compartment arranged between the outer surface and the inner surface, the controls compartment housing a battery and an electronics package including a wireless receiver, the electronics package providing the signal to the wireless motor system.

6. The system according to claim 5, further comprising a wireless motor support disposed in the wireless motor housing radially inwardly of the outer surface, the wireless motor support including a support portion and a conduit exposed to the controls compartment.

7. The system according to claim 6, wherein the controls compartment includes a first controls compartment, a second controls compartment, and a third controls compartment, the first controls compartment housing a first battery and a first electronics package, the second controls compartment housing a second battery and a second electronics package, and the third controls compartment housing a third battery and a third electronics package.

8. The system according to claim 7, wherein the wireless motor housing includes a first duct extending into the first controls compartment, a second duct extending into the second controls compartment, and a third duct extending into the third controls compartment.

9. The system according to claim 8, wherein the conduit includes a first conduit extending from the support portion into the first duct, a second conduit extending from the support portion into the second duct, and a third conduit extending from the support portion into the third duct.

10. The system according to claim 1, wherein the anchor comprises a slip.

11. A resource exploration and recovery system comprising:

a surface system;

a subsurface system; and a tubular string extending from the surface system into the subsurface system, the tubular string comprising:

an outer surface and an inner surface;

an anchor setting system disposed in the tubular string, the anchor setting system including a motor system;

an anchor assembly disposed on the tubular string, the anchor assembly including a slip and a setting system having a piston assembly;

a window cutting system supported by the tubular string; and an actuator extending from the motor system, through the window cutting system, to the piston assembly, the motor being selectively activated through a signal to deploy the slip.

12. The resource exploration and recovery system according to claim 11, wherein the motor system comprises a wireless motor system.

13. The resource exploration and recovery system according to claim 12, wherein window cutting system includes a window mill and a whipstock, the window mill being selectively connected to the whipstock.

14. The resource exploration and recovery system according to claim 13, wherein the actuator comprises a cable that extends from the wireless motor system through the window mill and the whipstock to the piston assembly.

15. The resource exploration and recovery system according to claim 12, wherein the anchor setting system includes a wireless motor housing having a controls compartment arranged between the outer surface and the inner surface, the controls compartment housing a battery and an electronics package including a wireless receiver, the electronics package providing the signal to the wireless motor.

16. The resource exploration and recovery system according to claim 11, further comprising a wireless motor support arranged in the wireless motor housing and disposed radially inwardly of the outer surface, the wireless motor support including a support portion and a conduit exposed to the controls compartment.

17. The resource exploration and recovery system according to claim 16, wherein the controls compartment includes a first controls compartment, a second controls compartment, and a third controls compartment, the first controls compartment housing a first battery and a first electronics package, the second controls compartment housing a second battery and a second electronics package, and the third controls compartment housing a third battery and a third electronics package.

18. The resource exploration and recovery system according to claim 17, wherein the wireless motor housing includes a first duct extending into the first controls compartment, a second duct extending into the second controls compartment, and a third duct extending into the third controls compartment.

19. The resource exploration and recovery system according to claim 18, wherein the conduit includes a first conduit extending from the support portion into the first duct, a second conduit extending from the support portion into the second duct, and a third conduit extending from the support portion into the third duct.

20. The resource exploration and recovery system according to claim 11, wherein the anchor comprises a slip.

* * * * *